US011067084B2

(12) United States Patent
Thomes et al.

(10) Patent No.: US 11,067,084 B2
(45) Date of Patent: Jul. 20, 2021

(54) PULSATION MUFFLERS FOR COMPRESSORS

(71) Applicant: GARDNER DENVER DEUTSCHLAND GMBH, Bad Neustadt (DE)

(72) Inventors: Ulrich Thomes, Kuelz (DE); Marc Schiel, Heinzenbach (DE)

(73) Assignee: GARDNER DENVER DEUTSCHLAND GMBH, Bad Neustadt (DE)

( * ) Notice: Subject to any disclaimer, the term of this patent is extended or adjusted under 35 U.S.C. 154(b) by 622 days.

(21) Appl. No.: 15/949,876

(22) Filed: Apr. 10, 2018

(65) Prior Publication Data

US 2018/0291905 A1 Oct. 11, 2018

(30) Foreign Application Priority Data

Apr. 10, 2017 (DE) ..... 102017107599.2

(51) Int. Cl.
*F04C 29/06* (2006.01)
*F01N 1/08* (2006.01)
(Continued)

(52) U.S. Cl.
CPC ..... *F04C 29/065* (2013.01); *F01N 1/084* (2013.01); *F01N 1/24* (2013.01); *F02M 35/1227* (2013.01);
(Continued)

(58) Field of Classification Search
CPC ..... F01N 1/083; F01N 1/084; F01N 2470/24; F01N 2490/155; F01N 2490/16;
(Continued)

(56) References Cited

U.S. PATENT DOCUMENTS 806,714 A * 12/1905 Porter ..... F01N 1/084 181/265
858,455 A * 7/1907 Hedstrom ..... F01N 1/166 181/236
(Continued)

FOREIGN PATENT DOCUMENTS

DE 1628835 A 6/1971
DE 2909675 C3 9/1980
(Continued)

OTHER PUBLICATIONS

German Patent Office Examination Report for Application No. 102017107601.8 dated Dec. 18, 2018 (7 pages).
(Continued)

*Primary Examiner* — Jeremy A Luks
(74) *Attorney, Agent, or Firm* — Kevin E. West; Advent, LLP

(57) ABSTRACT

The invention is related to a pulsation muffler (100) for a gaseous medium flow (107), which is supplied by a compressor. The pulsation muffler (100) comprises a housing (101) extending along a central axis with a medium flow inlet (106) and a medium flow outlet; several tubular absorber elements (108) concentrically arranged in the housing (10) and fluidically arranged one behind the other. Each tubular absorber element (108) is provided with an inlet area and an outlet area, positioned at an axial distance from each other. Between the respective radially adjacent wall sections of different absorber elements (108), a flow compartment (112, 114) is maintained for the medium flow (107).

20 Claims, 2 Drawing Sheets

(51) Int. Cl.

| | |
|---|---|
| ***F04C 29/00*** | (2006.01) |
| ***F01N 1/24*** | (2006.01) |
| ***F02M 35/12*** | (2006.01) |
| ***F04B 39/00*** | (2006.01) |

(52) U.S. Cl.
CPC ..... *F04B 39/0027* (2013.01); *F04B 39/0055* (2013.01); *F04C 29/0035* (2013.01); *F04C 29/063* (2013.01); *F01N 2470/24* (2013.01); *F04C 2240/30* (2013.01)

(58) Field of Classification Search
CPC .... F01N 2490/18; F01N 2490/20; F01N 1/24; F04C 29/06; F04C 29/063; F04C 29/065; F04C 29/0035; F04B 39/0027; F04B 39/0055; F04B 39/0061; F04B 39/0066
USPC ..... 181/230, 265
See application file for complete search history.

(56) References Cited

U.S. PATENT DOCUMENTS

| | | | | |
|---|---|---|---|---|
| 1,598,578 | A * | 8/1926 | Maxim | F01N 13/1855 181/265 |
| 1,953,543 | A * | 4/1934 | Rensink | F02M 35/14 96/383 |
| 2,050,581 | A * | 8/1936 | Strattner | F02M 35/1211 96/383 |
| 3,073,684 | A * | 1/1963 | Williams, Sr. | F01N 3/38 422/175 |
| 3,202,240 | A * | 8/1965 | Treiber | F01N 13/085 181/262 |
| 3,612,216 | A * | 10/1971 | Rieder | F04B 39/0055 181/265 |
| 4,212,599 | A | 7/1980 | Lantermann | |
| 4,362,462 | A | 12/1982 | Blotenberg | |
| 4,929,161 | A | 5/1990 | Aoki et al. | |
| 5,196,653 | A * | 3/1993 | Kiss | F01D 25/30 181/224 |
| 6,068,447 | A | 5/2000 | Foege | |
| 6,095,194 | A | 8/2000 | Minato et al. | |
| 6,210,132 | B1 | 4/2001 | Shiinoki et al. | |
| 6,302,236 | B1 | 10/2001 | Choyce | |
| 6,345,960 | B1 | 2/2002 | Persson et al. | |
| 6,595,757 | B2 | 7/2003 | Shen | |
| 6,739,841 | B2 | 5/2004 | Nishimura et al. | |
| 6,802,696 | B1 | 10/2004 | Verhaegen | |
| 7,118,348 | B2 | 10/2006 | Dean et al. | |
| 7,588,424 | B2 * | 9/2009 | Mrzyglod | F04B 35/045 181/229 |
| 7,610,993 | B2 * | 11/2009 | Sullivan | F01N 1/163 181/268 |
| 7,708,538 | B2 | 5/2010 | Kawabata et al. | |
| 8,241,009 | B2 | 8/2012 | Platteel et al. | |
| 8,302,732 | B2 * | 11/2012 | Gorke | F01N 1/084 181/265 |
| 8,616,856 | B2 | 12/2013 | Matsuzaka et al. | |
| 8,734,126 | B2 | 5/2014 | Nishimura et al. | |
| 8,919,491 | B2 * | 12/2014 | Trumler | G10K 11/172 181/196 |
| 9,328,731 | B2 | 5/2016 | Yabe et al. | |
| 2004/0101411 | A1 | 5/2004 | Nichol et al. | |
| 2006/0204371 | A1 | 9/2006 | Rexhauser et al. | |
| 2006/0280626 | A1 | 12/2006 | Nishimura et al. | |
| 2007/0189905 | A1 | 8/2007 | Dinsdale et al. | |
| 2007/0212229 | A1 | 9/2007 | Stavale et al. | |
| 2009/0304522 | A1 | 12/2009 | Lelong et al. | |
| 2010/0303658 | A1 | 12/2010 | Ito et al. | |
| 2013/0039737 | A1 | 2/2013 | Huberland et al. | |
| 2013/0136643 | A1 | 5/2013 | Yabe et al. | |
| 2015/0337845 | A1 | 11/2015 | Wenzel | |
| 2016/0097389 | A1 | 4/2016 | Yamazaki et al. | |
| 2016/0319809 | A1 | 11/2016 | Huetter | |
| 2016/0376952 | A1 * | 12/2016 | Sula | F01N 1/084 181/272 |
| 2017/0321699 | A1 | 11/2017 | Kawano et al. | |
| 2018/0030984 | A1 | 2/2018 | Sato et al. | |

FOREIGN PATENT DOCUMENTS

| | | | |
|---|---|---|---|
| DE | 2737677 | C2 | 5/1984 |
| DE | 9014888.6 | U1 | 1/1991 |
| DE | 69818687 | T2 | 4/2004 |
| DE | 69920997 | T2 | 3/2006 |
| DE | 60117821 | T2 | 11/2006 |
| DE | 102006020334 | A1 | 10/2007 |
| DE | 10003869 | C5 | 11/2007 |
| DE | 102014107126 | A1 | 11/2015 |
| DE | 102016100140 | A1 | 7/2017 |
| EP | 0 243559 | A1 | 11/1987 |
| EP | 1703618 | A1 | 9/2006 |
| EP | 1934476 | B1 | 7/2009 |
| EP | 2886862 | A1 | 6/2015 |
| FR | 2713702 | A1 | 6/1995 |
| JP | H03-108818 | U | 11/1991 |
| JP | 2008133811 | A | 6/2008 |
| WO | 2011130807 | A2 | 10/2011 |
| WO | 2012026317 | A1 | 3/2012 |
| WO | 2016129366 | A1 | 8/2016 |

OTHER PUBLICATIONS

European Patent Office Search Report for Application No. 18164781.9 dated Aug. 9, 2018 (8 pages).
European Patent Office Search Report for Application No. 18164786.8 dated Jul. 13, 2018 (8 pages).
German Patent Office Examination Report for Application No. 102017107602.6 dated Feb. 5, 2018 (6 pages).
Konka, "Schraubenkompressoren Technik and Praxis," VDI-Verlag GmBH, Düsseldorf, 1988, pp. 250-251, pp. 322-335, see pp. 332 et seq.
European Patent Office Search Report for Application No. 18164785.0 dated Sep. 5, 2018 (11 pages).
German Patent Office Examination Report for Application No. 102017107599.2 dated Feb. 5, 2018 (7 pages).

* cited by examiner

PULSATION MUFFLERS FOR COMPRESSORS

CROSS-REFERENCE TO RELATED APPLICATIONS

This application claims priority to German Patent Application No. DE102017107599.2, filed with the German Patent Office on Apr. 10, 2017, the contents of which are hereby incorporated in their entirety.

BACKGROUND

The invention relates to a pulsation muffler for a gaseous media flow, which is supplied by a compactor, specifically a compressor. Said muffler comprises a housing extending along a central axis with a media flow inlet and a media flow outlet, as well as one or several absorber elements, made of a sound-absorbing material acting as baffles.

A wide range of different compressor designs are known for the compression of gaseous media, particularly for the generation of pressurized air. For example, DE 601 17 821 T2 shows a multi-stage screw compressor with two or several compressor stages, each of said compressor stages comprising a pair of rotors for the compression of a gas. Furthermore, two or more driving means with variable speed are provided, each of said driving means driving a corresponding compressor stage. A control unit controls the speeds of the driving means, the torque and speed of each of said driving means being monitored, so that gas is provided by the screw compressor at a required flow rate and a required pressure, while the power consumption of the screw compressor must be minimized.

Compressors, particularly, such compressors operating according to the displacement principle, due to the discontinued ejection process at the pressure or ejection side of the compressor, often raise the issue of undesired pulsations, i.e., pressure changes, in the downstream components, e.g. pipelines, coolers, pressure containers etc. Due to the pressure changes and/or oscillations excited by said changes, said downstream components are submitted to a significant load, leading to e.g. material damages by fatigue. The pressure changes also give rise to significant noise emissions, based on the structure-borne sound initiation, sound forwarding and sound radiation. Furthermore, the pulsations, having a negative impact on the compressor stage, may affect the compression process itself. Said issues have a particular drastic effect on dry compressing screw compressors, in which partly considerable pulsations are observed at the outlet of the compressor stages. Since ejection processes are pulsed processes, the harmonics of the pulsation base frequency are also very pronounced, being in some cases even stronger than the base frequency itself.

Based on the above-stated processes and even more in view of the circumstance that many compressors are equipped with a speed control for the adjustment of the supplied quantities, the frequency spectrum of the pulsations is accordingly large. The required sound absorption of said accordingly large frequency spectrum places high demands on the pulsation mufflers implemented in the compressors.

From DE 699 20 997 T2 a pulsation muffler for a pump is known, comprising a device body and a membrane, said membrane dividing an interior compartment of the device body into a liquid chamber, which can temporarily store a liquid to be transported through a piston pump and a gas chamber, which is filled with a gas for the suppression of pulsations and which expands and contracts in order to change the capacity of the liquid chamber. This allows the attenuation of the pulsations based on an output pressure of the transported liquid.

DE 698 18 687 T2 describes a pulsation muffler for the attenuation of low frequency gas pulses with a container encompassing an inlet, an outlet and muffler elements, arranged in the container. At least the inlet or outlet is provided with a diffuser, provided with a tube-like part, said part being provided with first holes. The tube-like part comprises an element that is provided with a number of second holes and limited by reinforcing elements, extending around the perimeter, at least one of said second holes being covered by a plate which is provided with the first holes, which are smaller than the second openings.

SUMMARY

The present invention has the purpose to provide an enhanced pulsation muffler, appropriate for the implementation in compressors, specifically in screw compressors, said pulsation muffler having an affordable and simple design and showing high sound absorption values in a broad frequency spectrum. More specifically, the aim is to achieve, in terms of a short design length, a possibly high attenuation of the pulsations in the compressors, while only a low-pressure loss is present in the compressed medium. Furthermore, a remaining sound radiation via the housing of the pulsation muffler is to be minimized.

Such and further tasks are solved by a pulsation muffler according to the annexed claim 1. The sub-claims mention some preferred embodiments. Furthermore, the invention provides a compressor with said pulsation muffler.

The inventive pulsation muffler is appropriate for the attenuation of pulsations and the sound resulting therefrom in a gaseous media flow, to be supplied by a compressor. The pulsation muffler is also provided with a housing extending along a central axis with a medium flow inlet and a medium flow outlet. Furthermore, several tubular absorber elements are provided, which are made of sound absorbing material and are concentrically arranged with regards in the housing. The pulsation muffler deviates significantly from the known mufflers in that according to the state of the art, either only one single absorber element is used or that several absorber elements are axially arranged one after the other. Each tubular absorber element has an inlet area and an outlet area, positioned at an axial distance from each other, preferably arranged at the opposite end faces of the absorber element. The inlet area of the fluidic front absorber element is connected to the medium flow inlet of the housing, the outlet area of the fluidic front absorber element is connected to the inlet area of the next fluidic absorber element, etcetera, and the outlet area of the fluidic rear absorber element is connected to the medium outlet of the housing. Between each radially adjacent wall sections of different absorber elements, a flow compartment remains, through which the medium flow is directed.

The outlined design provides several absorber elements, hence several stages, which are nested one into the other. Each of said stages functions nearly as a separate absorber. The medium flow in the muffler changes its direction several times, it preferably meanders along the single absorber elements.

A significant advantage of the pulsation muffler consists in that the overall construction length is significantly reduced by the nested arrangement of the absorber elements and the resulting meander-type direction of the medium flow. Compared to the attenuation of the overall system, the length of the inventive muffler is by more than the half shorter than that of a traditional muffler with a linear direction of the medium flow. According to a first embodiment, the absorber elements consist of the same sound-absorbing material, operating all of said absorber elements in the same frequency range. In a modified embodiment, the single absorber elements are adjusted to the attenuation of the different frequency ranges, specifically by using different sound-absorbing materials. The absorber elements are preferably made of mineral material, metal or plastic fabric, metal or ceramic foams, whereby chamber-type structures are favorable. Multilayer absorber material layers are also used.

A preferred embodiment of the pulsation sound absorber uses rotation symmetrical absorber elements that interlock telescope-like and the arrangement of which is axially fixed in the housing. In modified embodiments however, the absorber elements also show a rectangular or polygonal section. It is specifically advantageous when at least three or more absorber elements are arranged in an annular design, leaving between the inner diameter of a corresponding external absorber element and the outer diameter of an opposite internal absorber element such a difference so as to form a flow compartment with a width of e.g. 5-10 mm. The absorber elements is preferably to be extended over nearly the same axial length, allowing the axial overlapping of the longitudinal extension of the absorber elements by at least 80%, preferably 90%, According to a preferred embodiment, the inlet area and the outlet area are respectively arranged at the end face of the absorber elements, the flow direction of the medium flow at the passage of one absorber element to the next absorber element experiencing a reverse direction of 180°. The fact that due to the nested arrangement of the tubular absorber elements, also an increased cross-section is available for the passage of the medium flow between the adjacent absorber elements (even with an equal gap width in the flow compartment), the flow speed is reduced so that an additional attenuation is achieved. According to the embodiment, easily the double of the cross-sectional area passage is achieved, which thus also leads to a clear speed reduction from one stage to the next stage. The reverse direction at the passage of the medium flow from one absorber element to the next absorber element is also used positively for enhancing sound-absorption properties, since due to the deflections, there is no direct "visual connection" between the medium flow inlet and the medium flow outlet, so that a direct "penetration" of higher frequency pulsations in downstream components is impeded.

By using the tubular absorber elements with available annular flow compartments in between, spacious cross-sections can be achieved for the direction of the medium flow, resulting in minimum pressure losses.

An advantageous embodiment is characterized in that there is provided a fluidic front absorber element at the radial inner side and a fluidic rear absorber element at the radial outer side. The housing preferably has an integrated absorber element area with a cruciform cross-section; a front plate at which the medium inlet is formed as a centrally positioned inlet opening, culminating at a central inlet area of the fluidic front absorber element; and a flange facing the front plate, forming the medium outlet and in which an annular outlet area of the fluidic rear absorber element is culminated. Since with this design the medium inlet in the muffler is located at the inside, the highest sound energy is also found there, i.e. far remotely from the outer housing wall. With a muffler provided with three absorber elements, also the next stage in the flow direction is found inside the muffler. In the last stage, which is formed by the absorber element adjacent to the housing, the sound energy has already decreased to such an extent that the sound energy radiated via the housing is minimal.

According to a preferred embodiment of the pulsation muffler, the axial length ratio to the maximum cross-sectional extension (e.g. diameter) of each absorber element is below 5, preferably below 2.5. A particularly preferred ratio for the radially outer absorber element is lower than 1, preferably lower than 0.75. It is also advantageous when the outer overall axial length ratio of the pulsation muffler with regards to the path length traveled by the medium flow through the absorber elements is lower than 1, preferably lower than 0.5.

The compressor provided by the invention for the compression of gaseous media comprises a compressor and a fluidic pulsation muffler arranged behind the compressor, said muffler formed according to the above-described embodiments or combinations of said embodiments. The compressor is preferably formed as a screw compressor or a double-screw compressor. A significant advantage of implementing the inventive pulsation muffler consists in the drastic reduction of the required construction size, impacting positively on the whole compressor.

A further developed embodiment of the pulsation sound absorber is characterized in that there are provided additional cavities in one or several absorber elements, acting as resonator chambers. The resonator chambers are preferably extended angularly to the flow compartments and are used for an additional pulsation and sound attenuation by using reflection and resonance effects.

BRIEF DESCRIPTION OF THE DRAWINGS

Further advantages and singularities are provided by the following description of a preferred embodiment as illustrated in the drawing. Below are shown.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

Figure 1:
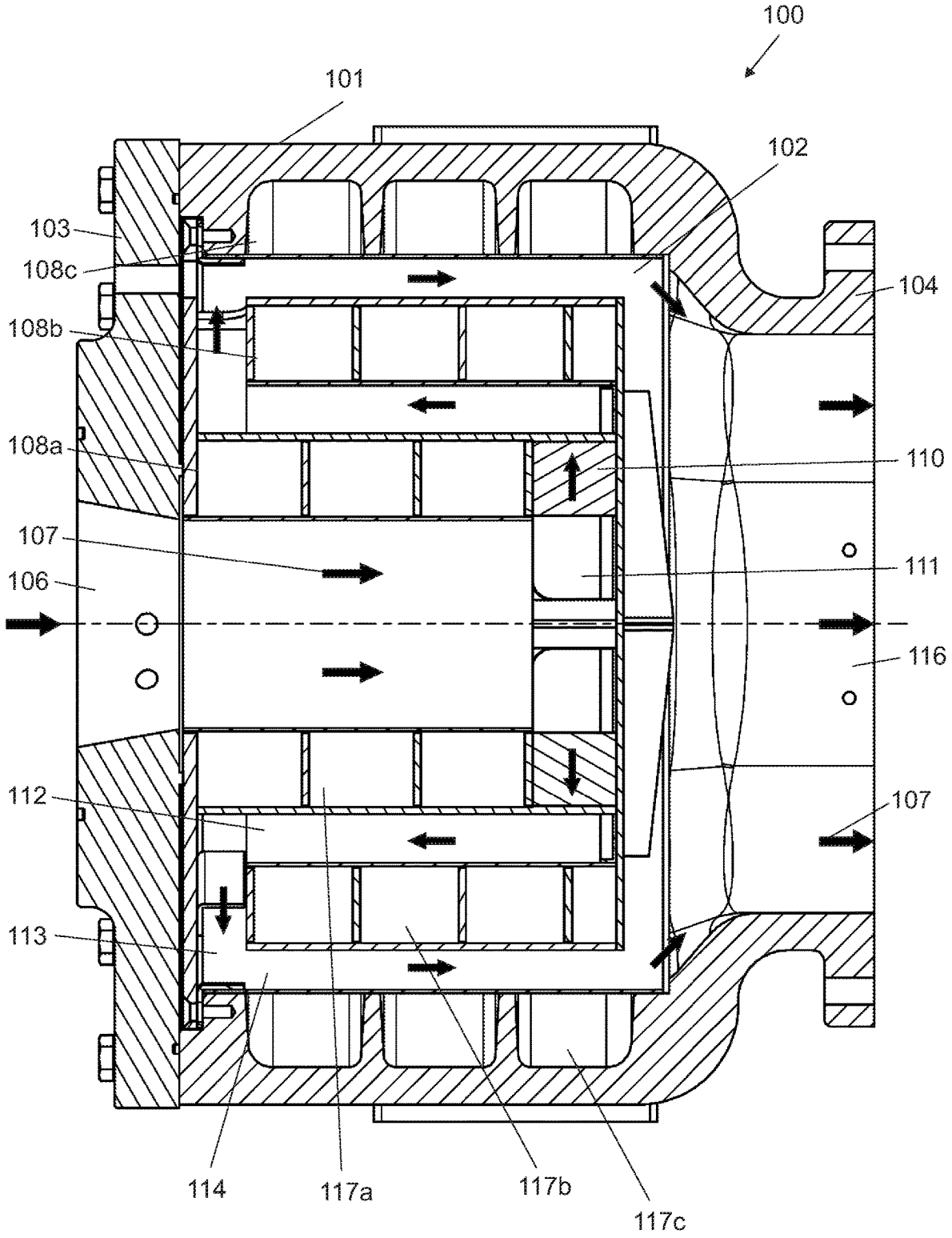
FIG. 1 illustrates a longitudinal section of an inventive pulsation muffler with three tubular absorber elements.
Figure 2:
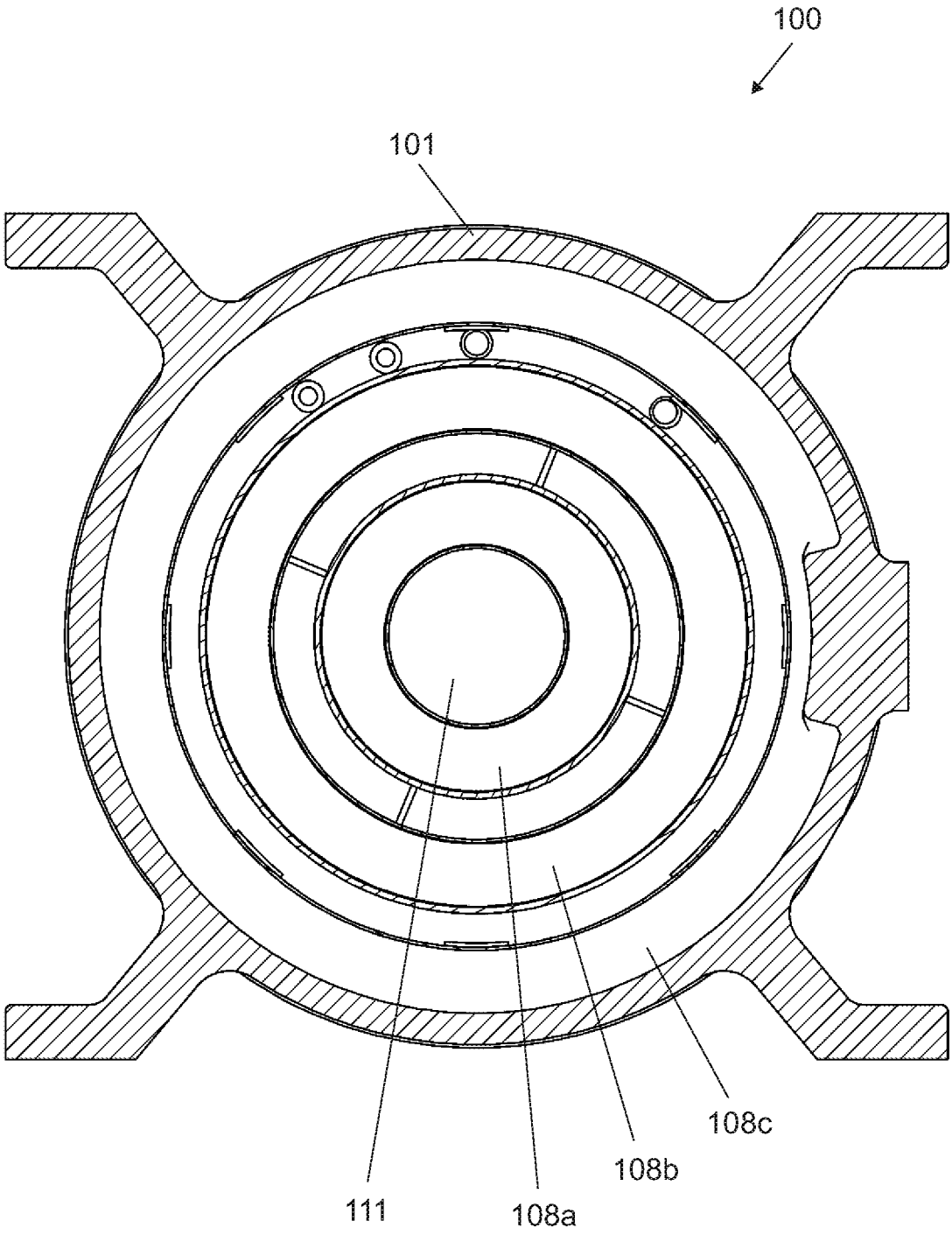
FIG. 2 illustrates a cross-section of the pulsation muffler according to FIG. 1.

FIG. 1 shows a simplified longitudinal section view of an inventive muffler 100, while FIG. 2 shows the cross-section thereof. In this example, muffler 100 primarily consists in a cylindrical housing 101 with an integrated absorber element area 102, one front plate 103 closing the housing at the end face and a flange 104 positioned axially opposite the front plate. Front plate 103 shows a centrally arranged medium flow inlet 106, via which a gaseous medium flow 107 compressed by a compressor is passed, specifically pressurized air, is fed.

In the integrated absorber element area 102, several tubular absorber elements 108 are arranged, illustrated in the example by a fluidic front absorber element **108*a*, a fluidic center absorber element 108*b* and a fluidic rear absorber element 108*c***. The three absorber elements are inserted into each other telescope-like and are primarily of the same length in axial direction. All absorber elements are made of sound-absorbing material, allowing the differentiated selection of the specific material properties between the single absorber elements.

The medium inlet flow 106 culminates in the centrally positioned inlet area of the front absorber element 108*a*, allowing the medium flow to pass next in the interior of the front absorber element 108*a*, where it is attenuated by said material. The internal compartment of the front absorber element 108*a* can be hollow or filled with gas-permeable material, whereby the flow resistance is to be maintained low. The end of the front absorber element 108*a* averted from front plate 103 is provided with an outlet area, allowing the medium flow to flow out from the front absorber element 108*a*. There, the medium flow passes in a first annular change area 110 into the inlet area of the center absorber element 108*b*, whereby the direction is reverted in the medium flow 107. The center absorber element 108*b* encompasses the fluidic front absorber element 108*a* in annular form, a centering pin 111 provided at the center absorber element 108*b* serving as a support for the front absorber element 108*a*. The medium flow 107 now passes through a first cylindrical flow compartment 112, extending axially between the front absorber element 108*a* and the center absorber element 108*b*.

At the end of the center absorber element 108*b* directed towards front plate 103, the medium flow leaves the first cylindrical flow compartment 112 via an outlet area and flows into a second annular change area 113 into the inlet area of the rear absorber element 108*c*. The medium flow 107 now passes through a second cylindrical flow compartment 114, which extends axially between the center absorber element 108*b* and the rear absorber element 108*c*. The flow direction in the second flow compartment 114 is axially opposed to the flow direction in the first flow compartment 112.

At the end of the rear absorber element 108*c* averted from front plate 103, the medium flow 107 leaves the integrated absorber element area 102 via an outlet area of the fluidic rear absorber element 108*c* and flows then through a medium flow outlet 116 in flange 104 to the downstream compressor units. The Figures show a clear increase of the cross-section available for the medium flow in the respective change areas, which is finally substantially larger at the medium flow outlet 116 than at the medium flow inlet 106.

The figures also show that the walls of all three absorber elements 108 are provided each with several resonator chambers 117*a*, 117*b* or 117*c*.

REFERENCE SIGN LIST

100 Pulsation muffler
101 Housing
102 Integrated absorber element area
103 Front plate
104 Flange
105—
106 Medium flow inlet
107 Medium flow
108 Absorber elements
109—
110 First change area
111 Centering pin
112 First flow compartment
113 Second change area
114 Second flow compartment
115—
116 Medium flow outlet
117 Resonator chamber Various features and advantages of the disclosure are set forth in the following claims.

What is claimed is:

1. A pulsation muffler for a gaseous medium flow supplied by a compressor, the pulsation muffler comprising:

a housing extending along a central axis with a medium flow inlet and a medium flow outlet, the medium flow outlet axially aligned with the medium flow inlet and having a cross sectional area that is larger than a cross sectional area of the medium flow inlet;

a plurality of tubular absorber elements, each made of sound-absorbing material, arranged concentrically in the housing, the plurality of tubular absorber elements including a fluidic front absorber element, a fluidic rear absorber element, and a fluidic intermediate absorber element disposed between the fluidic front absorber element and the fluidic rear absorber element, wherein each of the fluidic front absorber element, the fluidic rear absorber element, and the fluidic intermediate absorber element includes an inlet area and an outlet area positioned at an axial distance from the inlet area, wherein the inlet area of the fluidic front absorber element is connected to the medium flow inlet, the outlet area of the fluidic front absorber element is connected to the inlet area of the fluidic intermediate absorber element, and the outlet area of the fluidic rear absorber element is connected to the medium flow outlet; and a plurality of flow compartments defined between respective tubular absorber elements of the plurality of tubular absorber elements to permit flow of gaseous medium between radially adjacent wall sections of respective tubular absorber elements of the plurality of tubular absorber elements.

2. The pulsation muffler of claim 1, wherein at least one of the fluidic front absorber element, the fluidic rear absorber element, or the fluidic intermediate absorber element has a rotation-symmetrical design.

3. The pulsation muffler of claim 1, wherein each of the fluidic front absorber element, the fluidic rear absorber element, and the fluidic intermediate absorber element has a rotation-symmetrical design.

4. The pulsation muffler of claim 1, wherein the fluidic front absorber element, the fluidic rear absorber element, and the fluidic intermediate absorber element are interlocked and are axially fixed with respect to the housing.

5. The pulsation muffler of claim 1, wherein the fluidic front absorber element, the fluidic rear absorber element, and the fluidic intermediate absorber element have an annular arrangement with axial overlapping of at least 80% of a longitudinal extension of the fluidic front absorber element, the fluidic rear absorber element, and the fluidic intermediate absorber element.

6. The pulsation muffler of claim 1, wherein the fluidic front absorber element is arranged radially inwards in the housing and the fluidic rear absorber element is arranged radially outwards in the housing.

7. The pulsation muffler of claim 1, wherein an axial length ratio with regards to a maximum cross-sectional extension of each absorber element of the plurality of absorber elements is less than 2.5.

8. The pulsation muffler of claim 1, wherein an overall axial length ratio of the pulsation muffler with regards to a length of a path traveled by the gaseous medium from the medium flow inlet to the medium flow outlet is less than one.

9. The pulsation muffler of claim 1, wherein at least one of the fluidic front absorber element, the fluidic rear absorber element, or the fluidic intermediate absorber element includes a plurality of resonator chambers.

10. The pulsation muffler of claim 9, wherein each of the fluidic front absorber element, the fluidic rear absorber element, or the fluidic intermediate absorber element includes a plurality of resonator chambers.

11. The pulsation muffler of claim 9, wherein at least one resonator chamber of the plurality of resonator chambers is axially arranged with regards to at least one other resonator chamber of the plurality of resonator chambers.

12. A compressor for compressing gaseous media, comprising a compressor and the pulsation muffler of claim 1 coupled to an outlet of the compressor.

13. A pulsation muffler for a gaseous medium flow supplied by a compressor, the pulsation muffler comprising:

a housing extending along a central axis with a medium flow inlet and a medium flow outlet;

a plurality of tubular absorber elements, each made of sound-absorbing material, arranged concentrically in the housing, the plurality of tubular absorber elements including a fluidic front absorber element, a fluidic rear absorber element, and a fluidic intermediate absorber element disposed between the fluidic front absorber element and the fluidic rear absorber element, wherein at least one of the fluidic front absorber element, the fluidic rear absorber element, or the fluidic intermediate absorber element includes a plurality of resonator chambers, and wherein each of the fluidic front absorber element, the fluidic rear absorber element, and the fluidic intermediate absorber element includes an inlet area and an outlet area positioned at an axial distance from the inlet area, wherein the inlet area of the fluidic front absorber element is connected to the medium flow inlet, the outlet area of the fluidic front absorber element is connected to the inlet area of the fluidic intermediate absorber element, and the outlet area of the fluidic rear absorber element is connected to the medium flow outlet; and a plurality of flow compartments defined between respective tubular absorber elements of the plurality of tubular absorber elements to permit flow of gaseous medium between radially adjacent wall sections of respective tubular absorber elements of the plurality of tubular absorber elements.

14. The pulsation muffler of claim 13, wherein the plurality of resonator chambers is radially disposed with respect to the plurality of flow compartments.

15. The pulsation muffler of claim 13, wherein at least one resonator chamber of the plurality of resonator chambers is axially arranged with regards to at least one other resonator chamber of the plurality of resonator chambers.

16. The pulsation muffler of claim 13, wherein each of the fluidic front absorber element, the fluidic rear absorber element, and the fluidic intermediate absorber element has a rotation-symmetrical design.

17. The pulsation muffler of claim 13, wherein the fluidic front absorber element, the fluidic rear absorber element, and the fluidic intermediate absorber element are interlocked and are axially fixed with respect to the housing.

18. The pulsation muffler of claim 13, wherein the fluidic front absorber element, the fluidic rear absorber element, and the fluidic intermediate absorber element have an annular arrangement with axial overlapping of at least 80% of a longitudinal extension of the fluidic front absorber element, the fluidic rear absorber element, and the fluidic intermediate absorber element.

19. The pulsation muffler of claim 13, wherein the fluidic front absorber element is arranged radially inwards in the housing and the fluidic rear absorber element is arranged radially outwards in the housing.

20. The pulsation muffler of claim 13, wherein an axial length ratio with regards to a maximum cross-sectional extension of each absorber element of the plurality of absorber elements is less than 2.5.

* * * * *